US007900529B2

(12) United States Patent
Suzuki et al.

(10) Patent No.: US 7,900,529 B2
(45) Date of Patent: Mar. 8, 2011

(54) STARTUP TORQUE TRANSMITTING MECHANISM OF AN INTERNAL COMBUSTION ENGINE

(75) Inventors: Tomoaki Suzuki, Nagoya (JP); Toshiaki Asada, Mishima (JP); Makoto Ishikawa, Nishikamo-gun (JP); Toshimitsu Shiba, Toyota (JP); Kazuhito Sakai, Makinohara (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 395 days.

(21) Appl. No.: 11/997,055

(22) PCT Filed: Jul. 25, 2006

(86) PCT No.: PCT/IB2006/002024

§ 371 (c)(1), (2), (4) Date: Jan. 28, 2008

(87) PCT Pub. No.: WO2007/012946

PCT Pub. Date: Feb. 1, 2007

(65) Prior Publication Data

US 2008/0223156 A1 Sep. 18, 2008

(30) Foreign Application Priority Data

Jul. 29, 2005 (JP) ..... 2005-220104

(51) Int. Cl.
*F02N 15/02* (2006.01)

(52) U.S. Cl. ..... 74/7 C

(58) Field of Classification Search ..... 74/7 C, 74/9; 123/179.1; 290/10, 18, 22

See application file for complete search history.

(56) References Cited

U.S. PATENT DOCUMENTS

| | | | | |
|---|---|---|---|---|
| 4,693,348 | A | 9/1987 | Tsukamoto et al. | |
| 5,495,833 | A | 3/1996 | Ishizaka et al. | |
| 2004/0255890 | A1 * | 12/2004 | Tsutsumi et al. | 123/179.24 |
| 2007/0034030 | A1 * | 2/2007 | Suzuki et al. | 74/6 |
| 2009/0288295 | A1 * | 11/2009 | Suzuki et al. | 29/893.3 |

FOREIGN PATENT DOCUMENTS

| | | | |
|---|---|---|---|
| EP | 0 660 010 | B1 | 5/1998 |
| FR | 2 852 650 | A1 | 9/2004 |
| JP | 10122107 | A | 5/1998 |
| JP | 2000-274337 | A | 10/2000 |
| JP | 2003083216 | A | 3/2003 |
| WO | WO 97/31198 | A1 | 8/1997 |

* cited by examiner

*Primary Examiner* — Vicky A Johnson
(74) *Attorney, Agent, or Firm* — Sughrue Mion, PLLC

(57) ABSTRACT

An outer race support plate to which torque of a pinion gear is transmitted from a ring gear via a one-way clutch and thus rotates a crankshaft is provided separately from a flywheel and is mounted to the crankshaft not via the flywheel. As a result, impact noise produced when the one-way clutch engages is not directly transmitted to the flywheel. Accordingly, noise radiation from the flywheel can be suppressed, thereby enabling noise to be reduced.

11 Claims, 4 Drawing Sheets

STARTUP TORQUE TRANSMITTING MECHANISM OF AN INTERNAL COMBUSTION ENGINE

FIELD OF THE INVENTION

The invention relates to a startup torque transmitting mechanism for an internal combustion engine, which, by means of a one-way clutch, both transmits torque generated by a starter motor to a crankshaft side in one direction and prevents the transmission of torque in the other direction.

BACKGROUND OF THE INVENTION

In an internal combustion engine for a vehicle or the like, when a ring gear is provided for transmitting torque from a starter motor to a crankshaft, that ring gear is usually formed on an outer peripheral portion of a flywheel. Also, when a torque converter is provided, the ring gear may be formed on an outer peripheral portion of a drive plate which is fixed to a cover of the torque converter and transmits the rotation of the crankshaft.

Japanese Patent Application Publication No. JP-A-2000-274337, for example, discloses one such startup torque transmitting mechanism of an internal combustion engine, in which a one-way clutch is interposed between a ring gear and a flywheel so that a pinion gear on the starter motor side can be in constant mesh with the ring gear. Accordingly, the torque of the ring gear when the ring gear is rotated by the starter motor is transmitted to the crankshaft via the one-way clutch and the flywheel. When the crankshaft rotates from the output of the internal combustion engine, the one-way clutch releases so that torque from the crankshaft is not transmitted to the ring gear side.

In an internal combustion engine provided with a torque converter, it is possible to connect the ring gear to a drive plate, which transmits torque from the crankshaft to a cover of the torque converter, via the one-way clutch instead of connecting the ring gear to the flywheel. If the one-way clutch can be arranged on the drive plate in this way, torque from the ring gear that is rotated by the starter motor can be transmitted to the crankshaft via the drive plate while the ring gear is in constant mesh with the starter motor side, just as when a flywheel is used.

However, when employing a structure which transmits torque from the ring gear to a flywheel or a drive plate via a one-way clutch as described above, impact noise produced at the moment the one-way clutch engages immediately after the starter motor starts to be driven is directly transmitted to the flywheel or the drive plate. Therefore, noise may result from noise radiation from the flywheel or noise radiation from the drive plate itself or from the cover of the torque converter that is connected to the drive plate.

It is thus an object of the invention to reduce noise produced during engagement of a one-way clutch in a startup torque transmitting mechanism of an internal combustion engine which employs a one-way clutch.

DISCLOSURE OF THE INVENTION

In order to achieve the foregoing object, this invention thus provides a startup torque transmitting mechanism of an internal combustion engine, which, by means of a one-way clutch, both transmits torque generated by a starter motor to a crankshaft side in one direction and prevents the transmission of torque in the other direction, and which includes a race connecting member which is provided separately from a flywheel or a drive plate, is mounted to the crankshaft side, not via the flywheel or the drive plate, so as to rotate in conjunction with a crankshaft, and is connected to one race of the one-way clutch; and a ring gear which rotates upon receiving torque from the starter motor and is connected to another race of the one-way clutch.

As described above, the race connecting member to which torque generated by the starter motor is transmitted from the ring gear via the one-way clutch is provided separately from the flywheel or the drive plate, and is mounted to the crankshaft not via the flywheel or the drive plate.

Therefore, impact noise produced when the one-way clutch engages is not directly transmitted to the flywheel or the drive plate. As a result, it is possible to suppress noise radiation from the flywheel or the drive plate itself, or from a cover of the torque converter which is connected to the drive plate, which in turn enables noise to be reduced.

Furthermore, the fact that the race connecting member is separate from the flywheel or the drive plate also enables the following additional effects to be achieved. That is, regardless of the shape of the flywheel or the shape of the drive plate, or regardless of the type of transmission used, i.e., regardless of whether a manual transmission which uses a flywheel or an automatic transmission which uses a torque converter is used, component parts can be common by structuring the startup torque transmitting mechanism of an internal combustion engine as a common startup torque transmitting mechanism of an internal combustion engine.

The ring gear may also be rotatably supported by the crankshaft via a bearing.

Because the ring gear is rotatably supported by the crankshaft in this manner, impact noise produced by the one-way clutch engaging is not directly transmitted to the flywheel or the drive plate from the ring gear side either. Accordingly, noise radiation from the flywheel or the drive plate itself, or from a cover of the torque converter, can be suppressed, making it possible to reduce noise when the one-way clutch engages.

The one race of the one-way clutch may be an outer race and the other race of the one-way clutch may be an inner race, the race connecting member may be connected to the outer race of the one-way clutch, and the ring gear may be connected to the inner race of the one-way clutch.

In this way, the race connecting member is connected to the outer race of the one-way clutch and the ring gear is connected to the inner race. As a result, the one-way clutch and the mechanism such as the bearing which is between the ring gear and the crankshaft can be completely covered by the connecting body of the race connecting member and the outer race when viewed from one direction. Thus, because the one-way clutch and the bearing and the like which require an oil seal are able to be completely covered in this way, good sealability of the startup torque transmitting mechanism of an internal combustion engine can be easily realized.

The race connecting member may also be arranged on the opposite side of the ring gear from an internal combustion engine main body.

Having the ring gear on the internal combustion engine main body side and the race connecting member on the side of the ring gear opposite the internal combustion engine main body in this way makes it possible to completely cover the one-way clutch and the bearing and the like from outside of the internal combustion engine, and in particular, from the transmission side, by the race connecting member and the outer race. As a result, good sealability of the startup torque transmitting mechanism of an internal combustion engine with respect to the outside of the internal combustion engine can be easily realized. In addition, the startup torque transmitting mechanism of an internal combustion engine can be sealed so that oil will not leak out when the startup torque transmitting mechanism is completely separated from the transmission side. Accordingly, oil that is used to lubricate the internal combustion engine can also be used to lubricate the startup torque transmitting mechanism of an internal combustion engine.

A first oil seal member may be arranged in a gap between the outer race of the one-way clutch and the ring gear, and a second oil seal member may be arranged in a gap between the ring gear and an internal combustion engine main body side member.

Arranging the first oil seal member and the second oil seal member in this way makes it possible to seal the inside of the startup torque transmitting mechanism of an internal combustion engine against oil leaking out both easily and with good sealability. As a result, oil that is used to lubricate the internal combustion engine can also be used to lubricate the startup torque transmitting mechanism of an internal combustion engine.

The race connecting member may be fastened to a crankshaft end surface while being sandwiched between the crankshaft end surface and the drive plate, and a first load relieving portion which prevents deformation of the race connecting member that occurs due to pressure from the drive plate side may be formed on a flat surface side of the race connecting member on which the drive plate is arranged.

When the race connecting member is fastened in place by the drive plate while being sandwiched between the drive plate and the crankshaft end surface, deformation on the drive plate side may applied as pressure to the race connecting member. When this pressure is applied, the race connecting member side may also deform, which may affect the function of the one-way clutch and the sealability. Providing the first load relieving portion on the side on which the drive plate is arranged, however, makes it possible to prevent the race connecting member from deforming, thus preventing the sealability and the one-way clutch from being affected.

The first load relieving portion may be formed as a separated surface region in which a surface of the race connecting member is separated from the drive plate.

This structure easily enables the load generated by the pressure from the drive plate to be relieved, thereby making it possible to prevent the race connecting member from deforming.

A boundary between the separated surface region and a contacting surface region in which the surface of the race connecting member is contacting the drive plate may be within a region where the crankshaft end surface and the drive plate oppose one another.

Providing the boundary of the surface region within the region where the crankshaft end surface and the drive plate oppose one another enables an increase in load due to deformation of the drive plate to be released to the crankshaft side from the crankshaft end surface that supports the race connecting member from the opposite side, thus making it possible to prevent deformation of the outer race support plate.

The ring gear may be rotatably supported by the crankshaft via the bearing, and a boundary between the separated surface region and a contacting surface region in which the surface of the race connecting member is contacting the drive plate may be within a region that includes both a region where the drive plate opposes the crankshaft end surface and a region where the drive plate opposes an inner race end surface of the bearing.

There are cases in which the bearing is on the outside of the crankshaft and the inner race end surface of this bearing also sandwiches the race connecting member. In this case, the boundary of the surface region may also be within the region that includes both the region where the drive plate opposes the crankshaft end surface and the region where the drive plate opposes the inner race end surface of the bearing. As a result, an increase in load due to deformation of the drive plate can be released to the crankshaft side from the crankshaft end surface or from the inner race of the bearing, thus making it possible to prevent the race connecting member from deforming.

The drive plate may also be fastened in place by being pressed to the race connecting member side by a washer plate, a second load relieving portion to prevent a load produced by deformation of the drive plate from being applied to the race connecting member may be formed, as a separated surface region in which a surface of the washer plate is separated from the drive plate, on the washer plate, and the boundary between the separated surface region and the contacting surface region on the race connecting member side may be arranged offset in the radial direction with respect to a boundary between the separated surface region and a contacting surface region, in which the surface of the washer plate is contacting the drive plate, on the washer plate side.

When the drive plate is fastened in place by being pressed to the race connecting member side by a washer plate in this way, the boundary of the surface region on the race connecting member side is arranged offset in the radial direction with respect to the boundary of the surface region on the washer plate side. As a result, the point of contact of the washer plate side boundary that easily deforms when it receives a reaction force from the washer plate is different from the point of contact of the race connecting member side boundary that easily deforms when it receives a reaction force from the race connecting member. Thus, by inhibiting a deformation-causing reaction force from concentrating in one location in this way, it is possible to prevent the drive plate from cracking or the like, thus improving its durability.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

Figure 1:
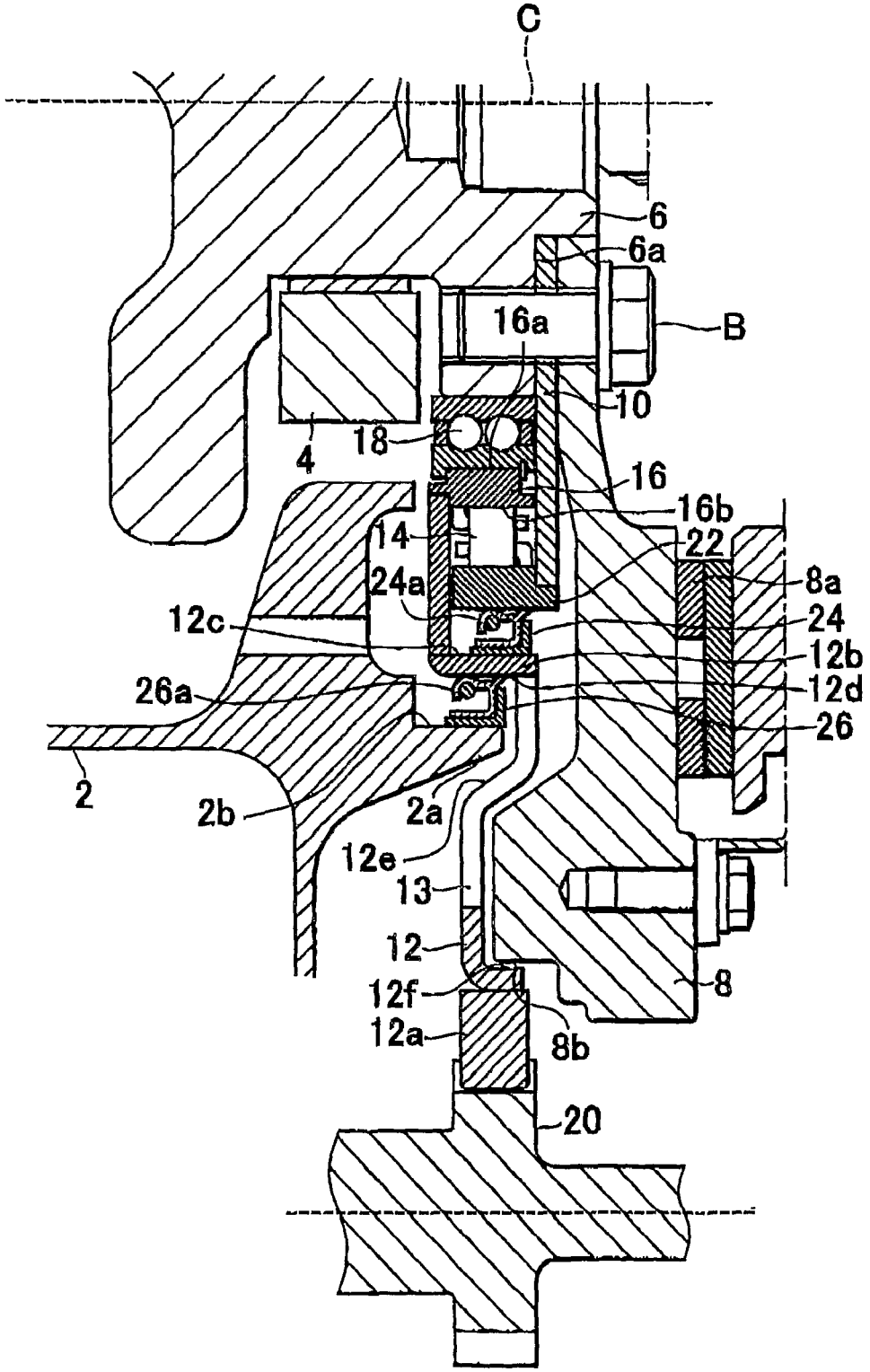
FIG. 1 is a longitudinal sectional view of a startup torque transmitting mechanism of an internal combustion engine according to a first embodiment of the invention.

FIG. 1 is a longitudinal sectional view of a startup torque transmitting mechanism of an internal combustion engine for a vehicle according to a first embodiment, and shows the area on the rear side of the internal combustion engine where power is output to the transmission side.

According to the first embodiment, as shown in FIG. 1, a rear end (i.e., the right end in the drawing) of a crankshaft 6 that is rotatably supported on a cylinder block side by a ladder beam 4 is arranged above a rear end (i.e., right end in the drawing) of an oil pan 2 of an internal combustion engine. As shown in the drawing, a flywheel 8, an outer race support plate 10 (which can be regarded as a race connecting member in the claims), and a ring gear 12 are all mounted to the rear end portion of the crankshaft 6.

The flywheel 8, the portion of which is below the center axis C being shown in FIG. 1, is substantially disc-shaped, with the center portion being open in the shape of a circle. A ring-shaped clutch disc 8*a*, which serves as a portion of a clutch mechanism for transmitting torque to and from a transmission, is mounted to a surface of the flywheel 8 on the side opposite the side contacting the outer race support plate 10. The clutch mechanism may also be formed separately from the flywheel 8.

The outer race support plate 10, the portion of which is below the center axis C being shown in FIG. 1, is formed in a flat circular shape with the center portion open. The outer race support plate 10 is fixed in place by a bolt both to the flywheel 8 and to a rear end surface (i.e., the right end surface in the drawing) 6*a* of the crankshaft 6 at the peripheral portion of the center opening, as shown in FIG. 1. As a result, the outer race support plate 10 rotates in conjunction with both the flywheel 8 and the crankshaft 6.

The ring gear 12, the portion of which is below the center axis C being shown in FIG. 1, is a circular disc in which the center portion is largely open and which has bent portions (a cylindrical stepped portion 12*b* and a curved portion 12*e*, which will be described later) in the radial direction. The ring gear 12 includes a flange-shaped inner race 16 of a one-way clutch 14 in the center open portion and a ring-shaped gear portion 12*a* on the outer peripheral portion. This ring gear 12 is mounted to the outer periphery of the crankshaft 6 via a bearing 18 (a roller bearing in this embodiment) on the center side, which is the side of the inner race 16 opposite the one-way clutch 14. Therefore, when the one-way clutch 14 is released, the ring gear 12 can rotate freely, independent of the rotation of the crankshaft 6.

The gear portion 12*a* of the ring gear 12 is in constant mesh with a pinion gear 20 of a starter motor. When torque from the starter motor is applied via the pinion gear 20 to this gear portion 12*a*, the ring gear 12 rotates. A plurality of hole portions 13 are formed in the ring gear 12 around the center axis C in a region between the cylindrical stepped portion 12*b* and the gear portion 12*a*. These hole portions 13 both reduce the weight of the ring gear 12 as well as make it possible to verify the state of the inside oil seal after the ring gear 12 has been arranged on the rear end surface 6*a* of the crankshaft 6, and the like.

An outer race 22 is mounted to the outer peripheral portion of the outer race support plate 10 on the outside side (i.e., the lower side in FIG. 1), opposing the inner race 16 which is mounted to the center open portion of the ring gear 12 such that a one-way clutch 14 is formed between the ring gear 12 and the outer race support plate 10. Thus, the bearing 18 is arranged on an inner peripheral surface 16*a* side of the inner race 16 and the one-way clutch 14 is formed on an outer peripheral side surface 16*b* side of the inner race 16, which is on the opposite side of the inner race 16 from the inner peripheral surface 16*a*. In this specification, the inner peripheral surface refers to the surface on the side facing (i.e, closest to) the center axis C. Conversely, the outer peripheral surface refers to the surface on the side that is farthest from the crankshaft.

The one-way clutch 14 engages the outer race support plate 10 with the ring gear 12 when the starter motor rotates the ring gear 12 via the pinion gear 20 during startup of the internal combustion engine, i.e., when the ring gear 12 is rotated in the direction that will enable torque to be transmitted to the outer race support plate 10. As a result, the starter motor can rotate the crankshaft 6.

When the internal combustion engine starts to operate under its own power and the rotation speed of the outer race support plate 10 which rotates in conjunction with the crankshaft 6 becomes faster than the rotation speed of the ring gear 12 from the starter motor due to the output of the internal combustion engine, the ring gear 12 side effectively rotates in the opposite direction relative to the outer race support plate 10 so the one-way clutch 14 releases. Therefore, even if the pinion gear 20 and the ring gear 12 are in a state of constant mesh, overspeed of the starter motor after startup of the internal combustion engine can be prevented.

In this case, engine oil is supplied via an oil passage in the cylinder block or the crankshaft 6 in order to lubricate the bearing 18 and the one-way clutch 14. However, the outer race support plate 10 and the ring gear 12 are arranged so as to sandwich the one-way clutch 14 so it is necessary to prevent oil from leaking out. Accordingly, a ring-shaped first oil seal member 24 is arranged between the outer race 22 of the one-way clutch 14, which is integrally mounted to the outer race support plate 10, and the cylindrical stepped portion 12*b* of the ring gear 12. This first oil seal member 24 is fixed to the ring gear 12 side by being fitted to an inner peripheral surface 12*c* of the cylindrical stepped portion 12*b*. A seal lip 24*a* which is formed on the inner peripheral side of the first oil seal member 24 is thus urged to slidably contact the outer peripheral surface of the outer race 22, thereby providing an oil seal.

A second oil seal member 26 which has a larger diameter than the first oil seal member 24 is arranged on the opposite side (the lower side in FIG. 1) of the cylindrical stepped portion 12*b* from the first oil seal member 24 such that the first oil seal member 24 and the second oil seal member 26 sandwich the cylindrical stepped portion 12*b*. This second oil seal member 26 is fixed in the position shown in the drawing by being fitted both to an inner peripheral surface 2*b* of the rear end (i.e., the right end in FIG. 1) 2*a* of mainly the oil pan 2 (which can be regarded as an internal combustion engine main side member in the claims) on the lower side in FIG. 1 of the crankshaft 6, and to the inner peripheral surface of the rear end (i.e., the right end in FIG. 1) of mainly the cylinder block (which can be regarded as an internal combustion engine main body side member in the claims) on the upper side in FIG. 1 of the crankshaft 6. Accordingly, a seal lip 26*a* which is formed on the inner peripheral side of the second oil seal member 26 slidably contacts an outer peripheral surface 12*d* of the cylindrical stepped portion 12*b*, thus providing an oil seal.

As described above, the outer race support plate 10 is formed separately from the flywheel 8 and is provided independently from the crankshaft 6 not via the flywheel 8. Therefore, impact noise produced when the one-way clutch 14 engages is not directly transmitted to the flywheel 8. Also, impact noise produced on the outer race support plate 10 side is not directly transmitted to the flywheel 8 because it must travel through the portion that is fastened by the bolt B.

The ring gear 12 is supported by the crankshaft 6 via the beating 18 so impact noise from the ring gear 12 is also not directly transmitted to the flywheel 8.

Furthermore, the positional relationship of the outer race support plate 10 and the ring gear 12 is such that the outer race support plate 10 is arranged on the opposite side of the ring gear 12 from the internal combustion engine main body side (i.e., the left side of the oil pan 2 in FIG. 1). Therefore, the one-way clutch 14 and the bearing 18 are both completely covered from the outside of the internal combustion engine by the connecting body of the outer race support plate 10 and the outer race 22.

The first embodiment described above can achieve the following effects.

(I) The outer race support plate 10 to which torque from the pinion gear 20 is transmitted from the ring gear 12 via the one-way clutch 14 and thus rotates the crankshaft 6 is provided separately from the flywheel 8 and is mounted to the crankshaft 6 not via the flywheel 8. Therefore, as described above, impact noise produced when the one-way clutch 14 engages is not directly transmitted to the flywheel 8. Accordingly, sound radiation from the flywheel 8 can be suppressed, making it possible to reduce noise.

(II) The ring gear 12 is rotatably supported by the crankshaft 6 via the bearing 18. Therefore, as described above, impact noise that is produced when the one-way clutch 14 engages is not directly transmitted to the flywheel 8 from the ring gear 12 side either. As a result, sound radiation from the flywheel 8 can be suppressed, making it possible to more effectively reduce noise.

(III) The outer race support plate 10 is connected to the outer race 22 of the one-way clutch 14, and the ring gear 12 is connected to the inner race 16 of the one-way clutch 14. Moreover, the Outer race support plate 10 is arranged on the opposite side of the ring gear 12 from the internal combustion engine main body. Therefore, the connecting body of the outer race support plate 10 and the outer race 22 can completely cover the bearing 18 and the one-way clutch 14 with from the outside of the internal combustion engine. As a result, good sealability of the startup torque transmitting mechanism of an internal combustion engine can be easily realized.

Therefore, as shown in FIG. 1, because the first oil seal member 24 is arranged in the gap between the outer race 22 and the ring gear 12, and the second oil seal member 26 is arranged in the gap between the ring gear 12 and the rear end (i.e., the right end in the drawing) 2*a* of the oil pan 2, it is possible to seal the inside of the startup torque transmitting mechanism of an internal combustion engine against oil leaking out both easily and with good sealability.

(IV) In the ring gear 12, the curved portion 12*e* is provided between the gear portion 12*a* and the cylindrical stepped portion 12*b*. When there is impact noise transmitted from the pinion gear 20 which is produced when the starter motor starts to drive or when there is impact noise transmitted from the one-way clutch 14 when the engine rotates in reverse, the ring gear 12 bends at the portion of this curved portion 12*e*, thus reducing the impact force, which protects the startup torque transmitting mechanism of an internal combustion engine, as well as the mechanism related to the startup torque transmitting mechanism, from impact force.

Also, when the bend in the curved portion 12*e* is large due to excessive impact force, the ring gear 12 deforms within the limitations of elastic deformation and contacts the flywheel 8. More specifically, as shown in FIG. 1, the inside portion 12*f* of the gear portion 12*a* contacts the outer peripheral portion 8*b* of the flywheel 8, which produces sliding resistance. This sliding resistance prevents damage to the ring gear 12 itself as well as damage to the bearing 18 when excessive impact force is input to the ring gear 12.

(V) The outer race support plate 10 is formed separately from the flywheel 8. As a result, even if the shape of the flywheel 8 with which it is combined is different, the outer race support plate 10 and the like can still be used as a common component part. Furthermore, the startup torque transmitting mechanism of an internal combustion engine according to this embodiment can be structured as a common startup torque transmitting mechanism of an internal combustion engine regardless of the type of transmission used, i.e., regardless of whether a manual transmission which uses a flywheel or an automatic transmission which uses a torque converter is used.

(VI) The outer race support plate 10 is formed separately from the flywheel 8 on which the clutch disc 8*a* is arranged. Moreover, on the outer peripheral side of the outer race support plate 10, the outer race support plate 10 and the flywheel 8 are separated from one another. As a result, heat from the clutch disc 8*a* that is generated when the clutch engages is not easily transferred particularly to the first oil seal member 24 that slidably contacts the outer race 22. Therefore, thermal degradation of the first oil seal member 24 does not easily occur so durability of the oil seal is improved.

Figure 2:
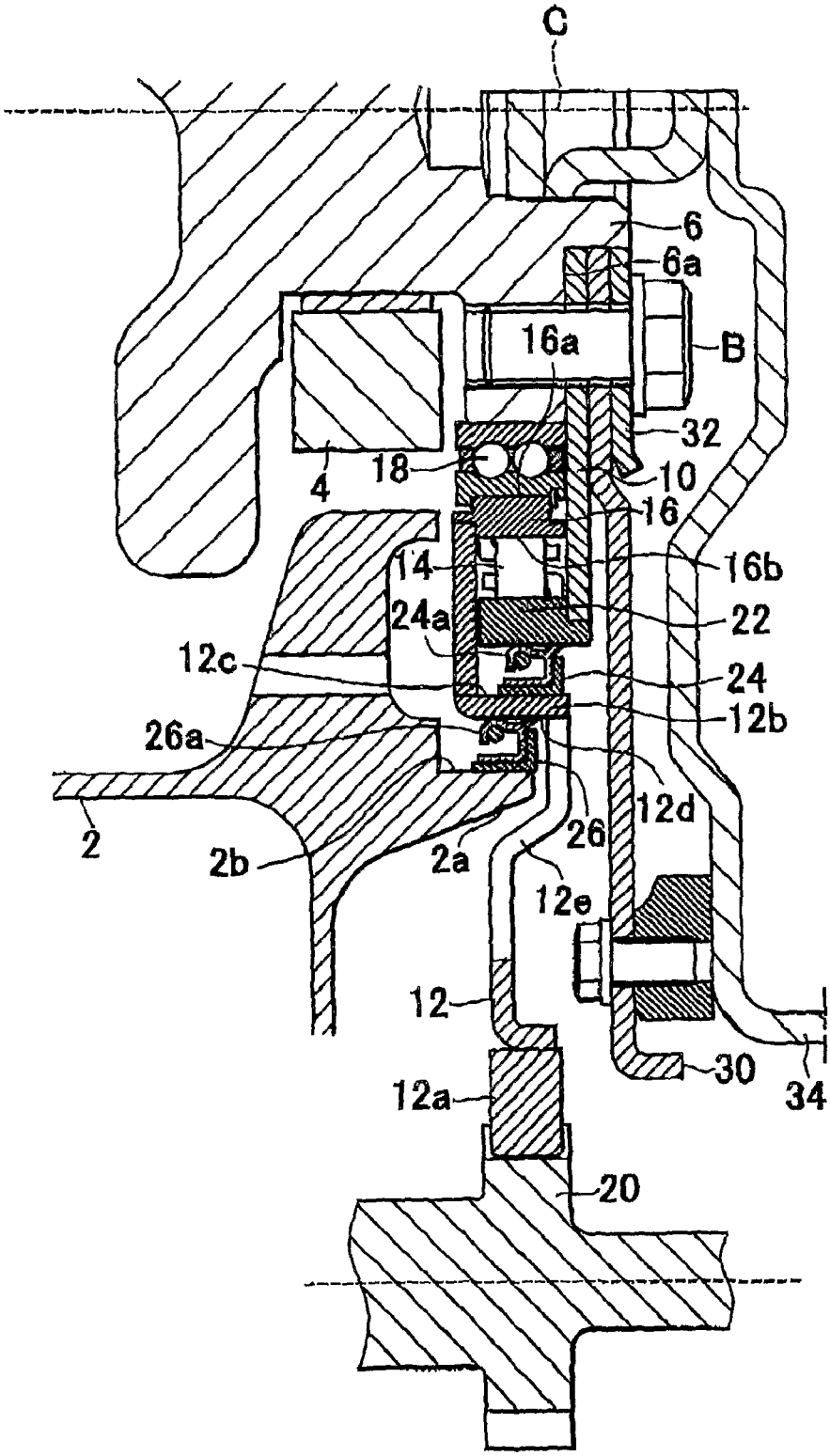
FIG. 2 is a longitudinal sectional view of a startup torque transmitting mechanism of an internal combustion engine according to a second embodiment of the invention.

FIG. 2 is a sectional view of a startup torque transmitting mechanism of an internal combustion engine for a vehicle according to a second embodiment of the invention, and shows the area on the rear side of the internal combustion engine where power is output to the transmission side.

According to the second embodiment, as shown in FIG. 2, a drive plate 30, not the flywheel, is fastened by a bolt to the outer race support plate 10 and the crankshaft 6. The outer race support plate 10 and the drive plate 30 are both fastened, together with a washer plate 32, to the rear end surface (i.e., the right end surface in FIG. 2) 6*a* of the crankshaft 6 by a bolt B.

The drive plate 30 is fastened by a bolt at the outer peripheral portion of a cover 34 of a torque converter. As a result, rotation of the crankshaft 6 is transmitted to the torque converter side by the drive plate 30.

The other structure is the same as that in the first embodiment described above and will therefore be denoted by the same reference numerals used in the first embodiment.

The second embodiment described above can achieve the following effects.

(I) The drive plate 30, instead of the flywheel, is mounted to the crankshaft 6, and the outer race support plate 10 is provided separately from this drive plate 30 and is mounted to the crankshaft 6 not via the drive plate 30. Therefore, as described above, impact noise produced when the one-way clutch 14 engages is not directly transmitted to the drive plate 30. Accordingly, sound radiation from the drive plate 30 itself or the cover 34 of the torque converter can be suppressed, making it possible to reduce noise.

(II) The effects described in II., III., IV, and V. in the first embodiment can also be obtained by this second embodiment. In particular, with respect to IV., sliding resistance occurs when the ring gear 12 contacts the drive plate 30, not the flywheel. This sliding resistance prevents damage to the ring gear 12 itself as well as damage to the bearing 18 when excessive impact force is input to the ring gear 12.

Figure 3:
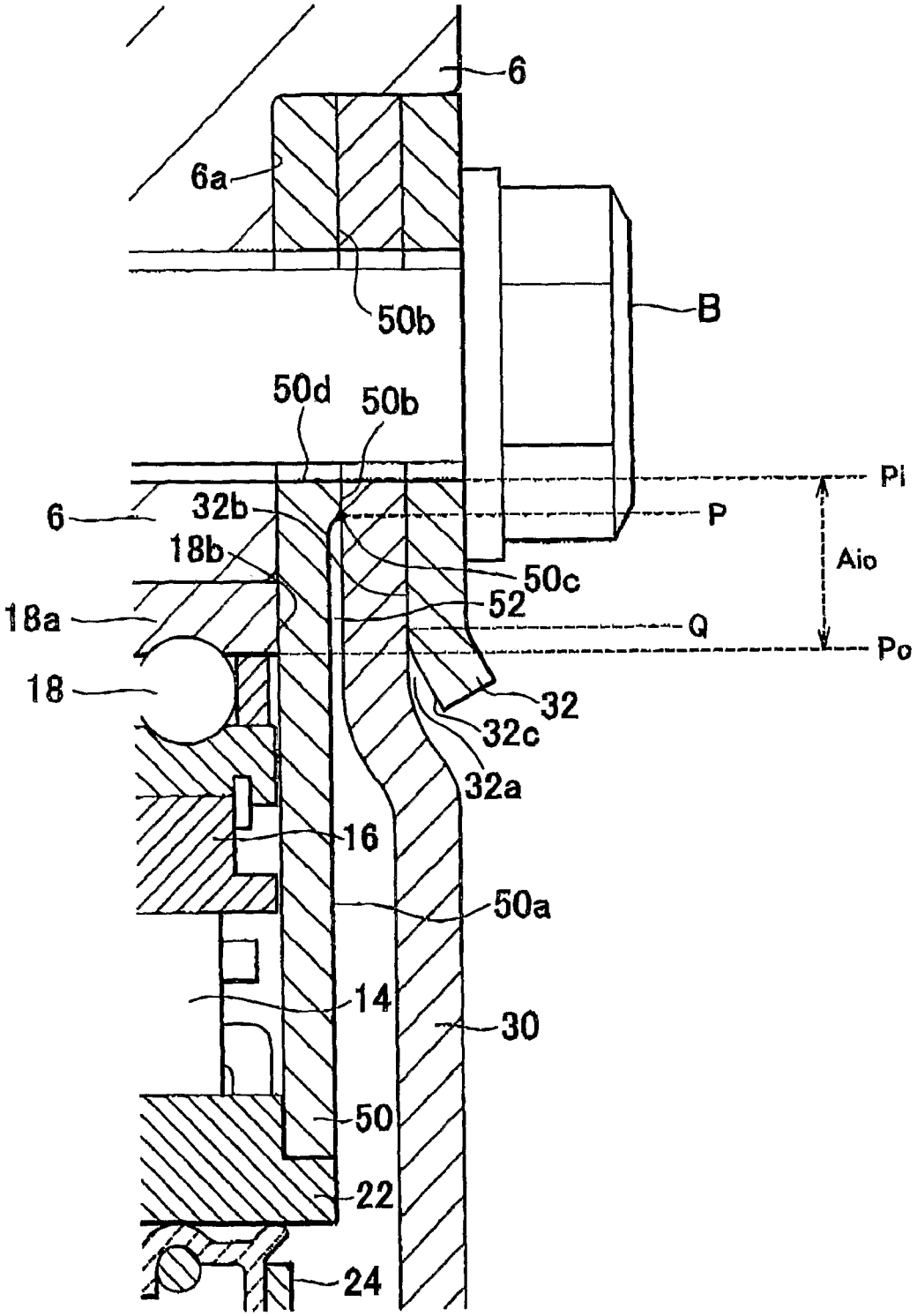
FIG. 3 is a longitudinal sectional view of a startup torque transmitting mechanism of an internal combustion engine according to a third embodiment of the invention.
Figure 4B:
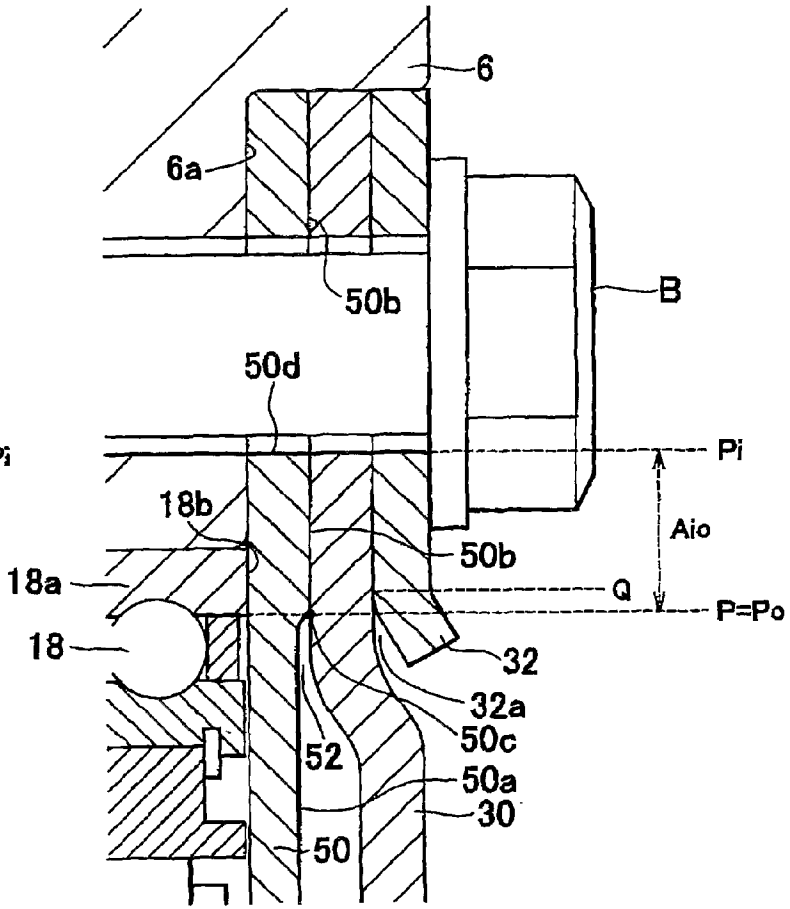
FIG. 4A and FIG. 4B are longitudinal sectional views of a startup torque transmitting mechanism of an internal combustion engine, which show a modified example of the position of a stepped portion that determines the range of a load relieving portion in the third embodiment.
Figure 4A:
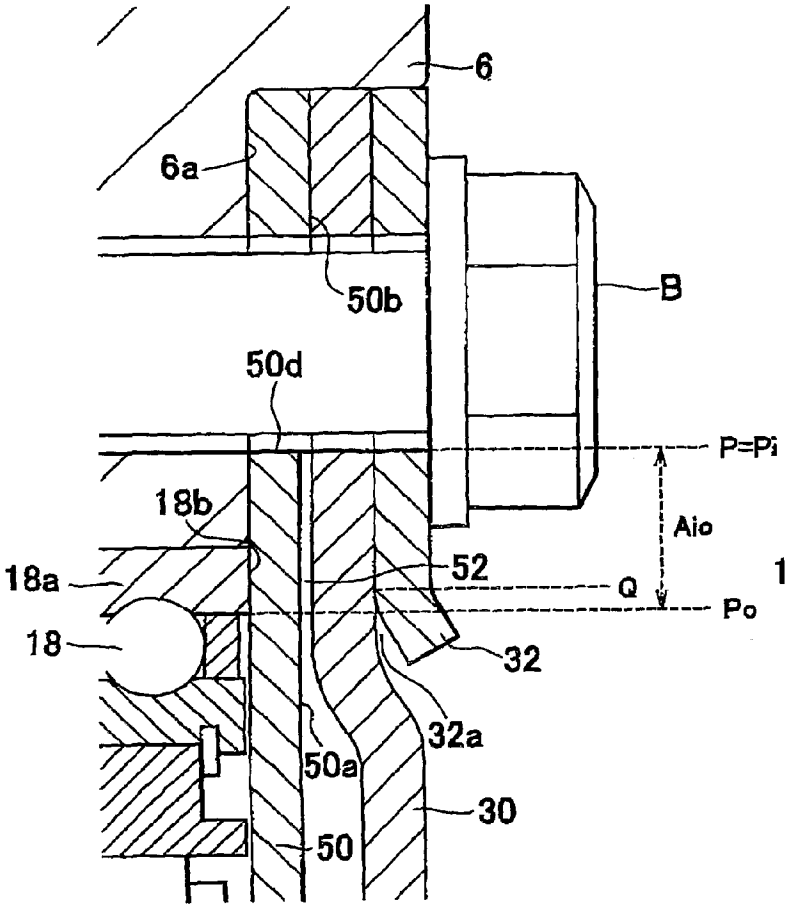

FIG. 3 is a sectional view of a startup torque transmitting mechanism of an internal combustion engine for a vehicle according to a third embodiment of the invention, and shows the area on the rear side of the internal combustion engine where power is output to the transmission side. Compared to FIG. 1 or FIG. 2, FIG. 3 shows an enlarged view of the area near the bolt B. FIG. 4A and FIG. 4B are views showing a modified example of the position of a stepped portion 50*c* which determines the range of the load relieving portion in the third embodiment.

The structure of the third embodiment shown in FIG. 3 differs from that of the second embodiment shown in FIG. 2 in that a load relieving portion 52, shown in the enlarged view of FIG. 3, is provided on a flat surface side of an outer race support plate 50 (which can be regarded as a race connecting member in the claims) on which the drive plate 30 is arranged. The other structure is the same as it is in the second embodiment and therefore will be denoted by like reference numerals.

Here, as shown in FIG. 3, the load relieving portion 52 is formed by a separated surface region 50*a* in which the surface of the outer race support plate 50 is separated from the surface of the drive plate 30, as compared to a portion of the outer race support plate 50 (i.e., a contacting surface region 50*b*) that is fasted to the drive plate 30 by the bolt B. As a result, with this load relieving portion 52, the drive plate 30 floats above the outer race support plate 50 so even if the drive plate 30 deforms, no load from the drive plate 30 will be applied to the outer race support plate 50 at the load relieving portion 52.

Here, a stepped portion 50*c*, which is the boundary between the separated surface region 50*a* and the contacting surface region 50*b*, is set in a position in which, when fastened by the bolt B, sufficient pressing force is applied to the contacting surface region 50*b* around the bolt B without it buckling. In the third embodiment, the position of a through-hole 50*d* for the bolt B which is farthest from the center axis C (see FIG. 1 or FIG. 2) is designated as a limit position Pi. This limit position Pi may be closer to the center axis C side than the position shown in FIG. 3.

A limit position Po to the outside (i.e., the lower side in FIG. 3) of the stepped portion 50*c* is located on the outermost side (i.e., the lower side in FIG. 3) of the inner race 18*a* of the bearing 18 that is press-fit to the outer periphery of the crankshaft 6. Therefore, the stepped portion 50*c* (the starting point P on the inside of the load relieving portion 52) may be set to the position Pi, as shown in FIG. 4A, or set to the position Po, as shown in FIG. 4B. The stepped portion 50*c* may also be arranged in any position (i.e., Aio) between the position Pi and the position Po.

Furthermore, as shown in FIGS. 3, 4A, and 4B, a load relieving portion 32*a* is also formed in the washer plate 32. It is important to note that the starting point P of the stepped portion 50*c* is offset in the radial direction from the starting point Q of the load relieving portion 32*a* on the washer plate 32 side.

The separated surface region 50*a* can be regarded as a surface region that is separated from the drive plate (i.e., a separated surface region) in the claims. The contacting surface region 50*b* can be regarded as a surface region that is contacting the drive plate (i.e., a contacting surface region) in the claims. The stepped portion 50*c* can be regarded as a boundary between the separated surface region and the contacting surface region in the claims. The starting point Q of the load relieving portion 32*a* formed on the washer plate 32 can be regarded as a boundary between the separated surface region on the washer plate side (32*c* in FIG. 3) and the contacting surface region (32*b* in FIG. 3) in the claims.

The third embodiment described above can achieve the following effects.

(I) The same effects obtained with the second embodiment are also obtained with this third embodiment.

(II) The outer race support plate 50 is fastened by the drive plate 30 by being sandwiched between it and the rear end surface (i.e., the right end surface in FIG. 3) 6*a* of the crankshaft 6. Therefore, if the cover 34 deforms (see FIG. 2) from a load applied to the torque converter such that the drive plate 30 deforms, that deformation may be applied to the outer race support plate 50 as pressure. Because the load relieving portion 52 is provided on the side of the outer race support plate 50 that contacts the drive plate 30, the load relieving portion 52 prevents that deformation from reaching the outer race support plate 50 side when that pressure is applied. As a result, in particular, it is possible to prevent that deformation from affecting the sealability of the first oil seal member 24 and one-way clutch 14.

Even if a load from the deformation of the drive plate 30 is applied to the contacting surface region 50*b*, the stepped portion 50*c* is positioned between the inside limit position Pi which is across from the rear end surface (i.e., the right end surface in FIG. 3) 6*a* of the crankshaft 6, and the outermost position Po (i.e., the lower side in FIG. 3) which is across from the inner race end surface 18*b* of the bearing 18. In this way, the stepped portion 50*c* is within a region that includes the region where the drive plate 30 opposes the rear end surface (i.e., the right end surface in FIG. 3) 6*a* of the crankshaft 6 and the region where the drive plate 30 opposes the inner race end surface 18*b* of the bearing 18. Therefore, regardless of which region the stepped portion 50*b* is in between the inside limit position Pi and the outside limit position Po, the load will be applied to either the crankshaft 6 or the inner race 18*a* of the bearing. Accordingly, the load from the pressure from the drive plate 30 is reliably released to the crankshaft 6 and the bearing 18 side, thereby making it possible to prevent deformation of the outer race support plate 50.

In FIGS. 3 and 4A, the position of the stepped portion 50*c* in the radial direction is entirely within the region where the drive plate 30 opposes the rear end surface (i.e., the right end surface in the drawings) 6*a* of the crankshaft 6. Therefore, an increase in load due to deformation of the drive plate 30 can be released to the crankshaft 6 from the rear end surface (i.e., the right end surface in the drawings) 6*a* of the crankshaft 6, thus making it possible to effectively prevent deformation of the outer race support plate 50.

In the example shown in FIG. 4B as well, the position of the stepped portion 50*c* in the radial direction is within the region where the drive plate 30 opposes the inner race end surface 18*b* of the bearing 18. Therefore, an increase in load due to deformation of the drive plate 30 can be released to the inner race 18*a* side of the bearing 18. This structure thus also makes it possible to prevent deformation of the outer race support plate 50.

(III) Moreover, in the examples shown in FIGS. 4A and 4B, the stepped portion 50*c* is arranged offset in the radial direction with respect to the starting point Q on the inside (the center axis C side) of the load relieving portion 32*a* of the washer plate 32 so that they do not overlap at the front and back of the drive plate 30 in the radial direction.

As a result, deformation of the drive plate 30 radially offsets the position of the drive plate 30 itself that easily deforms from the washer plate 32 side with respect to the position that easily deforms from the outer race support plate 50 side at the front and back of the drive plate 30.

In the third embodiment, the limit position Po on the outside of the stepped portion 50*c* is the outermost position in the region where the drive plate 30 and the inner race end surface 18*b* of the bearing oppose one another. Alternatively, however, the outside limit position Po may also be set to the outermost position in the region where the drive plate 30 and the rear end surface 6*a* of the crankshaft 6 oppose one another. This structure allows an increase in load due to deformation of the drive plate 30 to be reliably released from the rear end surface 6*a* of the crankshaft 6 to crankshaft 6 side, thereby making it possible to more reliably prevent deformation of the outer race support plate 50.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

The invention claimed is:

1. A startup torque transmitting mechanism of an internal combustion engine, comprising:

a one-way clutch which both transmits torque generated by a starter motor to a crankshaft side in one direction and prevents the transmission of torque in the other direction;

a race connecting member which is provided separately from a flywheel or a drive plate, is mounted to the crankshaft side, not via the flywheel or the drive plate, so as to rotate in conjunction with a crankshaft, and is connected to one race of the one-way clutch, the race connecting member is fastened to a crankshaft end surface while being sandwiched between the crankshaft end surface and the flywheel or the drive plate; and a ring gear which rotates upon receiving torque from the starter motor and is connected to another race of the one-way clutch, and a first load relieving portion which prevents deformation of the race connecting member that occurs due to pressure from the flywheel side or the drive plate side is formed on a flat surface side of the race connecting member on which the flywheel or the drive plate is arranged, wherein the first load relieving portion is formed as a separated surface region in which a surface of the race connecting member is separated from the flywheel or the drive plate.

2. The startup torque transmitting mechanism of an internal combustion engine according to claim 1, wherein the ring gear is rotatably supported by the crankshaft via a bearing.

3. The startup torque transmitting mechanism of an internal combustion engine according to claim 2, wherein the one race of the one-way clutch is an outer race and the other race of the one-way clutch is an inner race, the race connecting member is connected to the outer race of the one-way clutch, and the ring gear is connected to the inner race of the one-way clutch.

4. The startup torque transmitting mechanism of an internal combustion engine according to claim 3, wherein the race connecting member is arranged on the opposite side of the ring gear from an internal combustion engine main body.

5. The startup torque transmitting mechanism of an internal combustion engine according to claim 4, wherein a first oil seal member is arranged in a gap between the outer race of the one-way clutch and the ring gear, and a second oil seal member is arranged in a gap between the ring gear and an internal combustion engine main body side member.

6. The startup torque transmitting mechanism of an internal combustion engine according to claim 1, wherein the one race of the one-way clutch is an outer race and the other race of the one-way clutch is an inner race, the race connecting member is connected to the outer race of the one-way clutch, and the ring gear is connected to the inner race of the one-way clutch.

7. The startup torque transmitting mechanism of an internal combustion engine according to claim 6, wherein the race connecting member is arranged on the opposite side of the ring gear from an internal combustion engine main body.

8. The startup torque transmitting mechanism of an internal combustion engine according to claim 7, wherein a first oil seal member is arranged in a gap between the outer race of the one-way clutch and the ring gear, and a second oil seal member is arranged in a gap between the ring gear and an internal combustion engine main body side member.

9. The startup torque transmitting mechanism of an internal combustion engine according to claim 1, wherein a boundary between the separated surface region and a contacting surface region in which the surface of the race connecting member is contacting the flywheel or the drive plate is within a region where the crankshaft end surface and the flywheel or the drive plate oppose one another.

10. The startup torque transmitting mechanism of an internal combustion engine according to claim 1, wherein the ring gear is rotatably supported by the crankshaft via the bearing, and a boundary between the separated surface region and a contacting surface region in which the surface of the race connecting member is contacting the flywheel or the drive plate is within a region that includes both a region where the flywheel or the drive plate opposes the crankshaft end surface and a region where the flywheel or the drive plate opposes an inner race end surface of the bearing.

11. The startup torque transmitting mechanism of an internal combustion engine according to claim 1, wherein when a drive plate is used, the drive plate is fastened in place by being pressed to the race connecting member side by a washer plate, a second load relieving portion to prevent a load produced by deformation of the drive plate from being applied to the race connecting member is formed, as a separated surface region in which a surface of the washer plate is separated from the drive plate, on the washer plate, and the boundary between the separated surface region and the contacting surface region on the race connecting member side is arranged offset in the radial direction with respect to a boundary between the separated surface region and a contacting surface region, in which the surface of the washer plate is contacting the drive plate, on the washer plate side.

* * * * *